United States Patent [19]

Glass et al.

[11] Patent Number: 4,984,556

[45] **Date of Patent: * Jan. 15, 1991**

[54] DISK LAUNCHER

[76] Inventors: Henry G. Glass, P.O. Box 7553, Roanoke, Va. 24019; Herbert G. Glass, 4402 S. Park, Dothan, Ala. 36301

[ * ] Notice: The portion of the term of this patent subsequent to Mar. 15, 2005 has been disclaimed.

[21] Appl. No.: 302,298

[22] Filed: Jan. 27, 1989

[51] Int. Cl.[5] ..... F41B 3/04

[52] U.S. Cl. ..... 124/5; 124/42

[58] Field of Search ..... 124/4, 5, 42, 43; 403/161, 163

[56] References Cited

U.S. PATENT DOCUMENTS

| | | | |
|---|---|---|---|
| 1,468,004 | 9/1923 | Cavicchioli | 124/42 |
| 1,700,880 | 2/1929 | Camp | 124/5 |
| 3,095,867 | 7/1963 | Kiyuna | 124/5 |
| 3,537,438 | 11/1970 | Reed | 124/5 |
| 3,959,915 | 6/1976 | Kettlestrings | 124/42 |
| 4,076,004 | 2/1978 | Huelskamp | 124/5 |
| 4,170,215 | 10/1979 | Kettlestrings | 124/16 |
| 4,222,361 | 9/1980 | Jackson et al. | 124/5 |
| 4,233,952 | 11/1980 | Perkins | 124/5 |
| 4,730,595 | 3/1988 | Glass et al. | 124/5 |

*Primary Examiner*—Randolph A. Reese
*Assistant Examiner*—Jeffrey L. Thompson
*Attorney, Agent, or Firm*—Sughrue, Mion, Zinn, Macpeak & Seas

[57] ABSTRACT

A hand held disk launcher is constructed of one piece molded plastic material having a handle portion and a flat head portion and attachment means for a flexible member on opposite sides of the head portion whereby a flexible member may be detachably connected to the head portion on either side thereof to facilitate the use of the launcher by a left handed person or a right handed person. The flexible member is provided with a hook portion at the free end thereof for engagement with a complementary recess in a disk. The flexible member may be in the form of a completely flexible strap or a semi-rigid, flexible, resilient arm.

3 Claims, 2 Drawing Sheets

FIG. 3
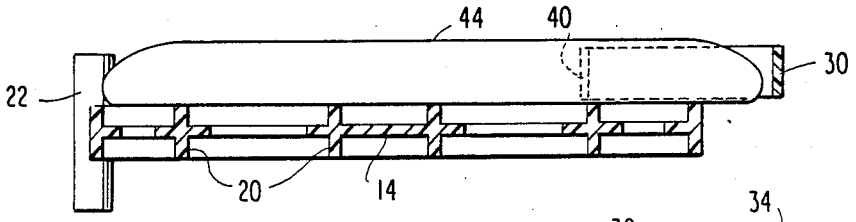
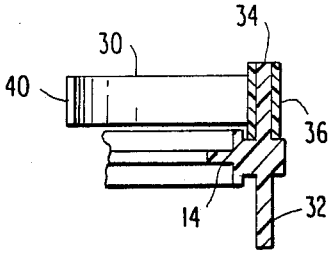
FIG. 4
FIG. 5
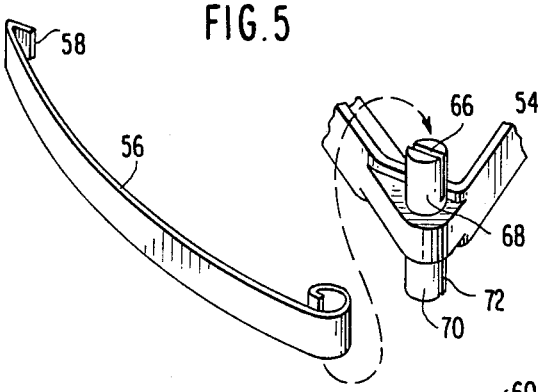
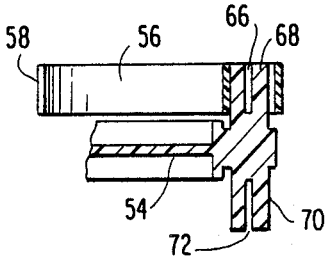
FIG. 7
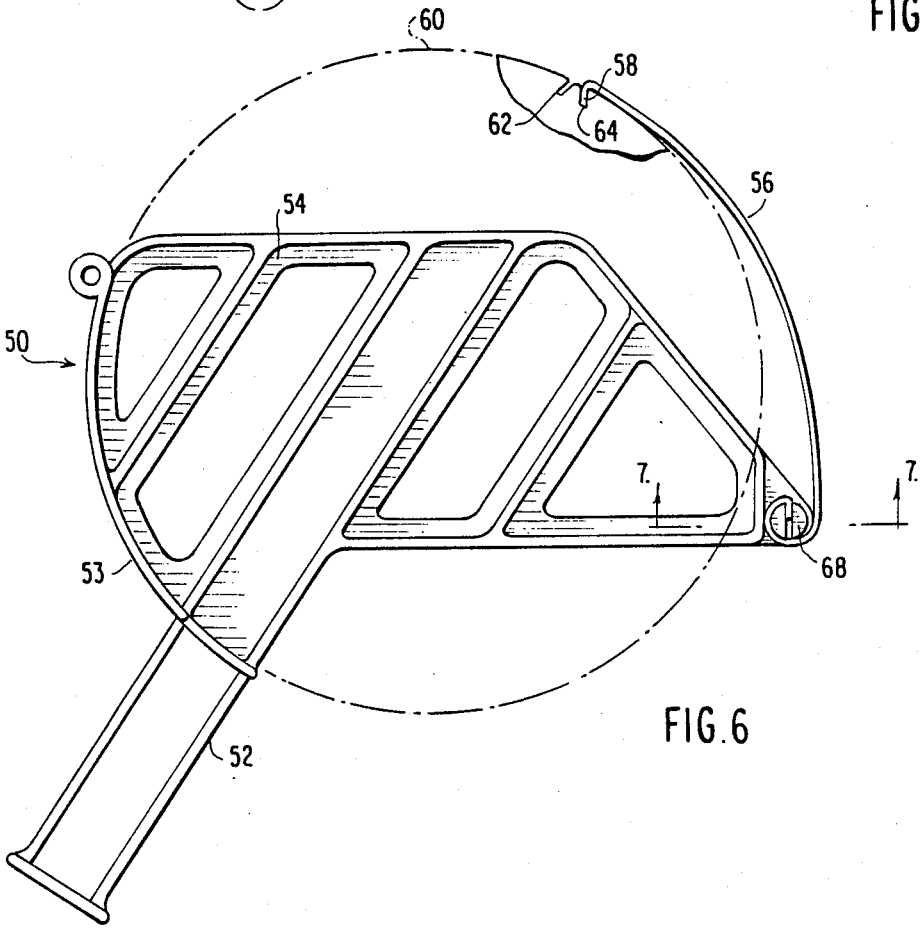
FIG. 6

DISK LAUNCHER

BACKGROUND OF THE INVENTION

The present invention is directed to a disk launcher, and more specifically to a hand held disk launcher having flexible means thereon cooperating with the disk to impart a spinning motion to the disk upon release from the launcher when the hand held launcher is subjected to a snapping or whipping action.

The use of hand held launchers having a target trap thereon for launching clay pigeon targets is old and well known in the trap shooting art. Such devices are generally complicated in construction and are comprised of a relatively large number of parts which are interconnected together with suitable springs or resilient members in order to hold the disk in position during the initial throwing action and to impact a spinning action to the disk as it is released from the launcher.

A typical prior art construction as shown in the Camp U.S. Pat. No. 1,700,880, has a resilient portion mounted thereon having a curved extension for receiving a stepped target disk. An arm is pivotally mounted on the resilient portion in opposition to the extension and is spring biased towards the extension in order to hold the disk between the pivoted arm and the extension. A rubber member is mounted at the outermost end of the pivoted arm and is maintained in engagement with the disk so that upon imparting a whipping motion to the launching device, the spring biased pivoted arm will be forced away from the extension, due to the centrifugal force acting on the disk, thereby allowing the disk to leave the launcher. As the disk leaves the launcher, it will be frictionally engaged with a rubber collar, whereby a spinning action will be imparted t the disk.

A similar hand operated target projecting device is also disclosed in the Reed U.S. Pat. No. 3,537,438. However, in Reed, a curved resilient arm is mounted in opposition to the extension of the handle member in order to hold the target disk therebetween. The outermost end of the resilient arm is provided with a spring clip 13 which frictionally engages the top and bottom surfaces of the disk so that upon launching the disk, a spinning movement will be imparted to the disk.

Another type of hand held launcher for clay pigeons is disclosed in U.S. Patent No. 4,076,004 to Huelskamp. The launcher is formed of a single piece of resilient plastic material. The arms of the head portion have flanges which encircle the clay pigeon and engage it on its outermost circumference. The flanges are symmetrical so that the launchers can be inverted for launching clay pigeons equally well with either the right hand or the left hand. The launcher is formed with a first or trailing arm which extends outwardly and laterally away from a neck portion. The shape of the first arm adjacent the neck portion is curved for a short distance and the remainder of the first arm is substantially straight. A second arm forms another part of the head portion and is substantially curved over its entire length. The arms define a substantially circular opening therebetween for receiving the clay pigeon. The arms surround more than 50% of the clay pigeon when located in a fully seated position in the launcher.

A plastic hand held disk launcher is also disclosed in Applicant's prior U.S. Pat. No. 4,730,595 granted Mar. 15, 1988. The disk launcher is comprised of a handle, a relatively flat open lightweight head extending outwardly from one end of the handle, disk engaging means disposed along one edge of the head on one side of the axis of the handle and projecting perpendicular to the plane of the head an equal distance on opposite sides of said plane. A curved resilient arm extends outwardly from the head on the opposite side of the axis with portions of the arm projecting on opposite sides of the plane of the head for gripping a disk between the resilient arm and the projection means on either side of the head. Engaging means are formed on the free end of the arm and are adapted to cooperate with complementary engaging means on a disk for engaging the disk and imparting a spinning action to the disk as the disk leaves the launcher under the action of centrifugal force. Additional means may be provided on the arm for adjusting the flexibility and resiliency of the arm.

SUMMARY OF THE INVENTION

The present invention provides a new and improved hand held disk launcher having a flexible arm detachably secured thereto on either side of the launcher and having means for engaging the disk to impart a spinning motion to the disk upon subjecting the hand held launcher to a whipping or snapping action wherein the arm has a width relative to the thickness of the disk so that the arm will lie completely within the plane of the disk.

The present invention provides a new and improved hand held disk launcher according to a first embodiment comprised of a handle, a relatively flat open lightweight head extending outwardly from one end of the handle, disk engaging means disposed along one edge of said head on one side of the axis of the handle and projecting perpendicular to the plane of said head an equal distance on opposite sides of said plane, attachment means disposed on opposite sides of said head on the opposite side of said axis from said disk engaging means, a curved flexible resilient arm having attachment means on one end of said arm complementary to said attachment means on said head, whereby said arm can be detachably secured to opposite sides of said head, engaging means on the opposite end of said arm for cooperating with complementary engaging means on a disk for engaging said disk and imparting a spinning action to said disk as the disk leaves the launcher under the action of centrifugal force.

The present invention provides a new and improved hand held disk launcher according to a second embodiment comprised of a handle, a relatively flat open lightweight head extending outwardly from one end of the handle, disk engaging means disposed along one edge of said head on one side of the axis of the handle and projecting perpendicular to the plane of said head an equal distance on opposite sides of said plane, attachment means disposed on opposite sides of said head and located on the opposite side of said axis from said disk engaging means, a flexible strap having attachment means at one end thereof complementary to said attachment means on said head whereby said strap may be detachably secured to opposite sides of said head and engaging means on the free end of said strap adapted to cooperate with complementary engaging means on a disk for engaging said disk and imparting a spinning action to said disk as the disk leaves the launcher under the action of centrifugal force.

The foregoing and other objects, features and advantages of the invention will be apparent from the following more particular description of a preferred embodiment of the invention as illustrated in the accompanying drawings.

BRIEF DESCRIPTION OF THE DRAWINGS

FIG. 3 is a sectional view taken along the line 3—3 in FIG. 2.

FIG. 4 is a sectional view taken along the line 4—4 in FIG. 2.

FIG. 5 is a partial perspective view showing a modified form of attachment means for securing a flexible strap to the disk launcher.

FIG. 6 is a plan view of the disk launcher according to the second embodiment with the flexible strap attached to the disk launcher and cooperating with a disk partially shown in phantom lines on the launcher.

FIG. 7 is a sectional view taken along the line 7—7 of FIG. 6.

DETAILED DESCRIPTION OF THE INVENTION

Figure 1:
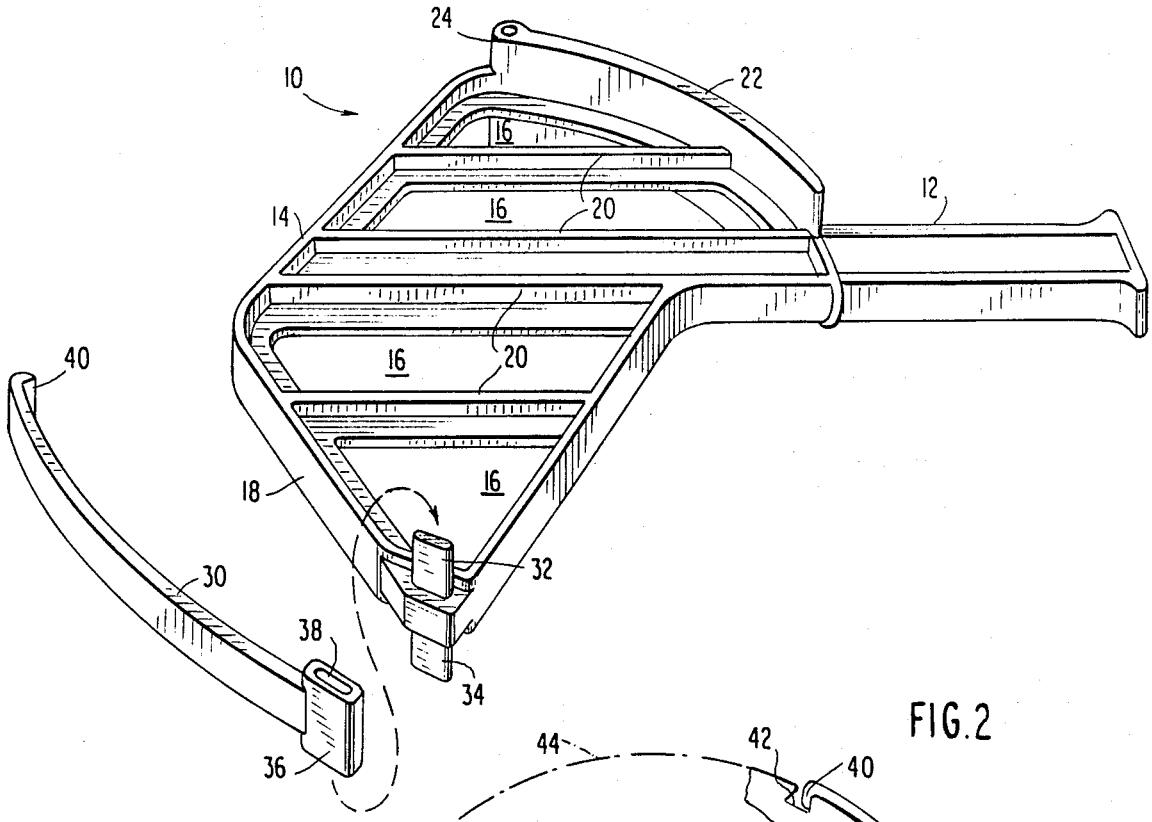
FIG. 1 is a perspective view of a hand held disk launcher according to a first embodiment of the present invention with the arm detached from the launcher.

The disk launcher 10 shown in the embodiment of FIGS. 1-4 inclusive has a one piece molded plastic construction including a handle 12 and a relatively flat head portion 14 extending outwardly from the handle 12. The flat head portion 14 is provided with a plurality of apertures 16 for the reduction of weight, a rib 18 extending about the entire periphery of the head and a plurality of transversely extending ribs 20 which extend substantially parallel to the axis of the handle 12. The rib 18 along one side of the head is substantially wider than the remaining portion of the rib 18 to define a support flange 22 which extends an equal distance on opposite sides of the plane of the head 14. The flange 22 terminates at one end adjacent the handle 12 and a thickened projection 24 is formed at the opposite end of the flange 22. The flange 22 has a curvature substantively equal to the curvature of the rim of a disk adapted to be used with the launcher for supporting the disk on the launcher. In lieu of the flange 22, a second projection similar to the projection 24 could be formed adjacent the handle 12 so that the two spaced apart projections would form a support for the periphery of the disk.

A flexible resilient arm 30 is provided which is adapted to be detachably secured to one side of the head 14 or the other, depending upon whether the person operating the launcher is left handed or right handed. A pair of identical projections 32 and 34 are integrally formed of one piece with the head 14 and have a substantially oblong cross-section. One end of the arm 30 is provided with an enlargement 36 having an aperture 38 extending therethrough and having a cross-section complementary to the cross-section of the projections 32 and 34 on the head. Therefore, the flexible resilient arm 30 may be quickly and detachably connected to either side of the head 14. The projections are located on the head at a point substantially diametrically opposite the projection 24 assuming the flange 22 is disposed along the arc of a circle. The arm 30 has a curvature substantially the same as the curvature of the flange 22 and has a uniform width along the entire length of the arm from the enlargement 36 to a hook-like projection 40 integrally formed at the opposite end of the arm 30. The hook-like projection 40 has a width equal to the width of the arm 30 and is adapted to mate with a complementary groove 42 formed in the periphery of a disk 44 shown in phantom lines in FIG. 2. The groove 42 is provided with two oppositely directed re-entrant portions, thereby enabling the hook-like projection 40 to engage in the groove in either direction.

Figure 2:
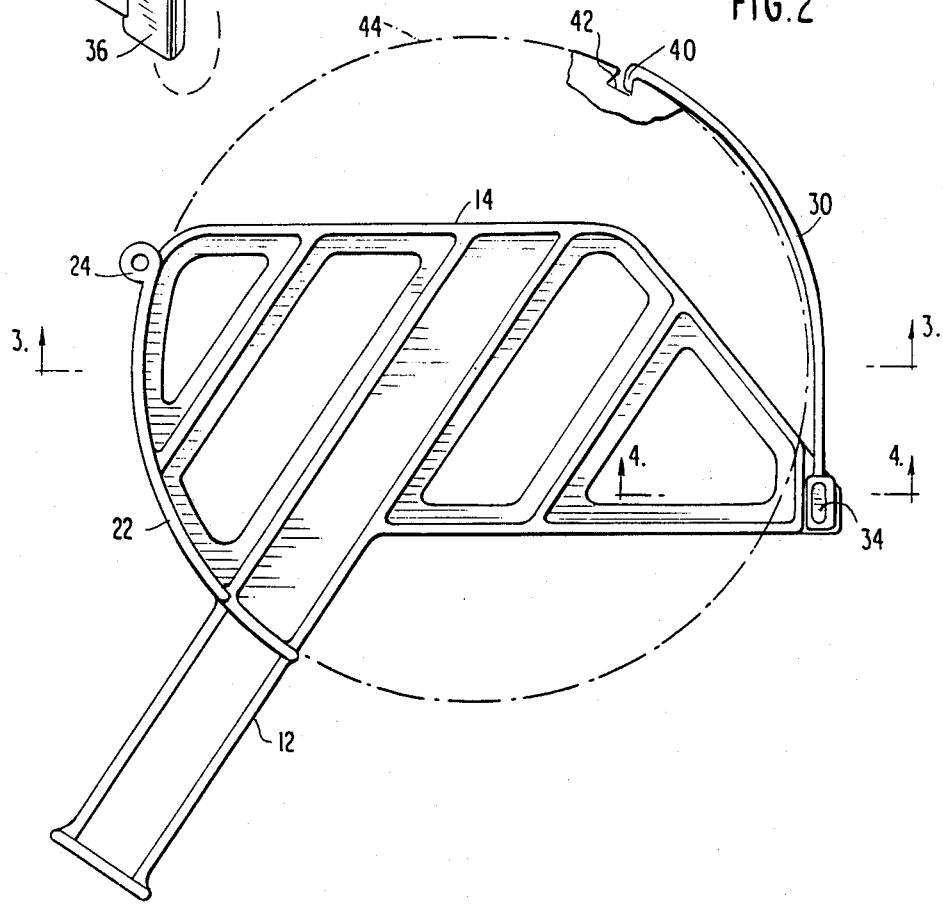
FIG. 2 is a plan view of the disk launcher shown in FIG. 1 with the arm attached to the disk launcher and disposed in cooperating engagement with a disk partially shown in phantom lines.

The operation of the disk launcher 10 can be readily understood from the illustration of the disk with the launcher in FIG. 2, wherein the curved, flexible, resilient arm 30 is mounted on the side of the head 14 whereby the disk launcher would be operated by a left handed person. The disk 44 would be placed on the upper surface of the head 14 with the hook-like projection 40 on the arm 30 disposed in engagement with the groove 40 on the periphery of the disk. A left handed person would then grasp the handle with the left thumb placed on the upper surface of the disk 44 adjacent the edge thereof. The launcher will then be moved forwardly with a substantially horizontal side arm motion to provide a whipping or snapping action which will impart a centrifugal force to the disk 44 sufficient to overcome the force of the resilient, flexible arm 30 when the thrower releases the thumb pressure on the disk. As the disk 44 leaves the launcher, it will pivot about the hook-like projection 40 due to the engagement between the projection 40 and the groove 42 formed in the periphery of the disk to impart a spinning motion to the disk.

In the embodiment of FIGS. 5-7 inclusive, the disk launcher 50 is provided with a handle portion 52 and a head portion 54 substantially identical to the handle and head portion shown in the first embodiment with the exception of the projections for attaching the flexible arm. In the second embodiment, the flexible, resilient arm has been replaced by a flexible strap 56 having a relatively rigid hook member 58 molded on one end thereof for cooperation with a complementary angle slot 64 formed in the periphery of the disk 60. A second slot 62 is provided in the periphery of the disk 60 for engagement by the hook portion 58 of the strap 56 when the strap is secured to the opposite side of the launcher.

The strap 56 may be comprised of nylon reinforced plastic material which is completely flexible and does not have any resiliency. The end of the strap 56 opposite the rigid hook portion 58 is adapted to be inserted in a diametrically extending slot 66 disposed in a post 68 which is integrally molded with the head portion 54 and extends perpendicular thereto. A similar post 70 having a slot 72 is formed on the opposite side of the head 54. By wrapping the end of the flexible strap about the post, the strap will be secured to the post. It is also possible to provide a permanent set to the end of the strap opposite the hook 58 in the configuration shown in FIG. 5.

The operation of the launcher 50 can be readily understood from the illustration of the disk 60 with the launcher in FIG. 6. The flexible strap 56 is attachably secured to the post 68 and a disk 60 is located on the same side of the head as the post 68 with the disk in engagement with the support flange 53. In this configuration, the launcher is set up for use by a left handed person. The hook 58 of the strap 56 is placed in engagement with the notch 64 in the periphery of the disk 60 located on the upper surface of the head portion 54. A left handed person would then grasp the handle with the thumb placed on the upper surface of the disk 60 adjacent the edge thereof. The launcher will then be moved forward with a substantially horizontal side arm motion to provide a whipping or snapping action which will impart a centrifugal force to the disk 60. As the disk leaves the launcher, the flexible strap 56 will swing about the post 68 until it is fully extended whereupon the disk will tend to pivot about the hook 58 as it separates from the strap to impart a spinning motion to the disk.

While the invention has been particularly shown and described with reference to preferred embodiments thereof, it will be understood by those in the art that the foregoing and other changes in form and details may be made therein without departing from the spirit and scope of the invention.

What is claimed is:

1. A disk and disk launcher comprising a disk having at least one peripheral recess, said disk launcher comprising a handle, a flat head portion extending outwardly from one end of the handle and disposed in a common plane with said handle, disk support means disposed along one end of the head portion on one side of the axis of said handle and projecting perpendicular to said plane an equal distance on opposite sides of said plane, an elongated flexible member detachably connected to said head portion and having a free end extending outwardly from a flex point on said head portion on the opposite side of said axis, and a pair of identical attachment means disposed opposite each other on opposite surfaces of said flat head portion at said flex point to which said flexible member may be selectively and detachably connected and projecting means on the free end of said flexible member adapted to cooperate with said recess on said disk for engaging said disk and imparting a spinning action to said disk as the disk leaves the launcher upon flexing of the flexible member about said flex point under the action of centrifugal force imparted thereto.

2. A disk and disk launcher as set forth in claim 1 wherein said attachment means is comprised of a pair of oppositely extending posts having a non-circular cross-section and wherein said flexible member is provided with an enlargement at an end thereof opposite said free end and provided with a non-circular aperture complementary to said non-circular post.

3. A disk and disk launcher as set forth in claim 1 wherein said attachment means is comprised of a pair of oppositely extending posts each having a transversely extending slot therein and said flexible member is comprised of a flexible strap having an end opposite said free end adapted to be inserted in said slot and wrapped about said post to detachably connect the flexible member to said head portion.

* * * * *